US008424796B2

(12) United States Patent
Witwer et al.

(10) Patent No.: US 8,424,796 B2
(45) Date of Patent: Apr. 23, 2013

(54) REEL

(75) Inventors: Richard P. Witwer, Lancaster, PA (US); Seth Galewyrick, Asheville, NC (US); Andrew Weiman, Langhorne, PA (US); John Coleman, Philadelphia, PA (US)

(73) Assignee: Direct Wire & Cable, Inc., Denver, PA (US)

( * ) Notice: Subject to any disclaimer, the term of this patent is extended or adjusted under 35 U.S.C. 154(b) by 300 days.

(21) Appl. No.: 12/944,359

(22) Filed: Nov. 11, 2010

(65) Prior Publication Data

US 2011/0253830 A1 Oct. 20, 2011

Related U.S. Application Data

(60) Provisional application No. 61/324,377, filed on Apr. 15, 2010.

(51) Int. Cl.
*B65H 75/22* (2006.01)

(52) U.S. Cl.
USPC ..... 242/608.6; 242/609.1; 242/118.6

(58) Field of Classification Search ..... 242/607, 242/608, 608.2, 608.6, 609, 609.1, 613.4, 242/407.1, 118.4, 118.6, 118.61, 608.7
See application file for complete search history.

(56) References Cited

U.S. PATENT DOCUMENTS

| | | | | |
|---|---|---|---|---|
| 2,585,159 | A | 12/1952 | Morley | |
| 3,940,085 | A | 2/1976 | Campbell | |
| 4,471,919 | A * | 9/1984 | Leunig | 242/608.2 |
| 5,575,437 | A | 11/1996 | Campbell | |
| 5,806,788 | A | 9/1998 | Witwer et al. | |
| 5,868,348 | A | 2/1999 | Bulman | |
| 5,967,454 | A | 10/1999 | Yarnell et al. | |
| 5,975,459 | A | 11/1999 | Roman | |
| 6,089,500 | A | 7/2000 | Hafner | |
| 6,102,327 | A | 8/2000 | Ripplinger | |
| 6,199,786 | B1 | 3/2001 | Lessard et al. | |
| RE37,442 | E | 11/2001 | Spear et al. | |
| 6,352,216 | B1 | 3/2002 | Coats | |
| 6,883,744 | B2 | 4/2005 | Couchey et al. | |
| 7,036,766 | B2 | 5/2006 | Place et al. | |
| 7,073,746 | B2 | 7/2006 | Barroso | |
| 7,364,113 | B2 | 4/2008 | Ripplinger | |
| 2002/0053625 | A1 | 5/2002 | Charlton | |

(Continued)

OTHER PUBLICATIONS

International Search Report and Written Opinion mailed Jun. 2, 2011 issued in International Patent Application No. PCT/US2011/031365.

*Primary Examiner* — William E Dondero
(74) *Attorney, Agent, or Firm* — Howsn & Howson LLP

(57) ABSTRACT

A reel comprises a cylindrical core composed of two complementary arcuate core segments, a pair of flanges disposed respectively at axially spaced opposite ends of the core, and a pair of rings for connecting the core to the flanges. The rings are fixed respectively to facing inner sides of the flanges. Cooperating slots and tongues on the rings and core elements prevent the flanges from moving relative to the core in the direction of the axis of the core. The tongues enter the slots when the core segments are brought together. Resiliently bendable locking arms protrude radially inward from both ends of each core segment, and each locking arm is engageable by a snap fit with one of the rings when the core segments are brought together. Access openings in the flanges adjacent each of the locking arms allow access to the locking arms for disengagement from the rings.

13 Claims, 8 Drawing Sheets

U.S. PATENT DOCUMENTS

| | | | |
|---|---|---|---|
| 2004/0113011 | A1 | 6/2004 | Place |
| 2004/0206850 | A1 | 10/2004 | Hafner |
| 2005/0145746 | A1 | 7/2005 | Place |
| 2005/0279877 | A1 | 12/2005 | Barroso |
| 2006/0214045 | A1 | 9/2006 | Alkalay et al. |
| 2007/0181739 | A1 | 8/2007 | Derendal |
| 2007/0241226 | A1 | 10/2007 | Manzo |
| 2007/0262192 | A1 | 11/2007 | Derendal |
| 2008/0135676 | A1 | 6/2008 | Hafner |
| 2009/0084887 | A1 | 4/2009 | Aiston et al. |

* cited by examiner

REEL

CROSS-REFERENCE TO RELATED APPLICATIONS

This application claims the benefit under 35 USC §119(e) of U.S. Provisional Patent Application No. 61/324,377, filed Apr. 15, 2010.

FIELD OF THE INVENTION

This invention relates to reels, and more particularly to a reel for storing and transporting cable, wire, flexible tubing or the like, which can be readily disassembled after the supply of cable or the like is exhausted to facilitate shipment to a location where the reel can be reassembled and replenished with a supply of cable or the like.

BACKGROUND OF THE INVENTION

In the wire and cable industry, it is conventional practice to ship wire or cable wound on reels to a user. After unwinding the wire or cable from the reel, the user either disposes of the reel, or returns the reel for re-use.

A reel is composed of a cylindrical drum or core having flanges at its opposite ends for retaining cable, wire, or the like wound around the drum. To facilitate shipment of exhausted reels, various knockdown or collapsible reels have been designed. In a typical knockdown reel, the core is composed of two complementary, interlocking, semi-cylindrical parts which, when together, provide a circular, cylindrical outer surface. The two semi-cylindrical parts interlock with a pair of flanges to form a complete reel.

One such knockdown reel is described in U.S. Pat. No. 3,940,085, granted Feb. 24, 1976 to Kenneth E. Campbell. In the reel described in the Campbell patent, each of two semi-cylindrical core halves is formed with an arcuate ridge at both of its ends. The ridges are received in annular grooves formed in bosses on a pair of flanges. The core halves are secured to each other by bolts, and when they are secured together, the arcuate ridges are locked in the annular grooves, and the core and flanges are rigidly held together.

Another knockdown reel is described in U.S. Pat. No. 5,575,437, granted Nov. 19, 1997 to Kenneth E. Campbell. In this reel, semi-cylindrical core halves are connected to circular recesses in specially formed flanges by means of resilient, axially extending, latching fingers.

In still another knockdown reel, described in U.S. Pat. No. 5,806,788, granted on Sep. 15, 1998 to Richard P. Witwer and Kenneth E. Campbell, core halves are formed with locking fingers that engage notches formed on the peripheries of core-supporting hubs fastened to flanges.

Although the knock-down reels described in these patents have served reliably in the cable industry for many years, there remains a need for a more robust reel that can withstand impact, temperature variations and other forms of stress more reliably. For example, it is important for a reel to be able to withstand the impact that results when it is dropped from a fork lift or from the bed of a flat bed trailer.

SUMMARY OF THE INVENTION

The reel according to the invention comprises a cylindrical core composed of two complementary arcuate core segments, a pair of flanges disposed respectively at axially spaced opposite ends of the core, and a pair of rings for connecting the core to the flanges. The rings are fixed respectively to mutually facing inner sides of the flanges. Cooperating slots and tongues on the rings and core elements prevent the flanges from moving relative to the core in the direction of the axis of the core. The tongues enter the slots when the core segments are brought together. Resiliently bendable locking arms protrude radially inward from both ends of each core segment, and each locking arm is engageable by a snap fit with one of the rings when the core segments are brought together.

Preferably, access openings are provided in the flanges adjacent each of the locking arms to allow access to the locking arms for disengagement from the rings.

More particularly, a preferred embodiment of the reel comprises a core having a substantially circular cylindrical outer surface symmetrical about a core axis. The core is composed of a plurality of complementary, connected, arcuate core segments, and has two axially spaced opposite ends. Flanges are disposed respectively at the axially spaced opposite ends of the core, and have inner sides facing each other. Rings for connecting the core to the flanges, are fixed to the inner sides of the flanges whereby the rings are located opposite to each other.

Arc-shaped connecting are elements formed on the core segments at the opposite ends of the core, and arc-shaped connecting elements are also formed on the rings. The arc-shaped connecting elements of the core segments are engageable with the arc-shaped connecting elements formed on the rings and are fully engaged when the arcuate core segments are in complementary relationship to form a core having a circular cylindrical outer surface. The cooperation of the arc-shaped connecting elements locks the flanges against axial movement relative to the core. The arc-shaped connecting elements of the core segments are movable radially outward relative to the core axis for disengagement from the arc-shaped connecting elements formed on the rings.

Locking arms are connected to, and extend radially inward from, both ends of each core segment. The locking arms have end portions with radially outward facing locking surfaces. These locking arms are resiliently bendable so that their end portions can move through a limited range in a direction substantially parallel to the core axis. Each ring has radially extending slots for receiving the locking arms, so that the locking arms can move radially inward in the slots when the arc-shaped connecting elements of the core segments are engaged with the arc-shaped connecting elements formed on the rings. Each slot of each ring has a wall facing the opposite ring, the wall being positioned for sliding engagement with a locking arm and for bending the locking arm toward the opposite ring as the locking arm moves radially inward. Each wall also has a radially inward facing surface for locking engagement with a radially outward facing surface of a locking arm. The inwardly facing surfaces of the walls and the outwardly facing surfaces of the locking arms are positioned for automatic engagement with each other by resilient movement of the arms when the arc-shaped connecting elements of the core segments are fully engaged with the arc-shaped connecting elements formed on the rings. The end portion of each locking arm that has a radially outward facing surface engaged with a radially inward facing surface of a wall of a ring, is movable toward the opposite ring for disengagement of the engaged surfaces.

Preferably, the flanges have access apertures in register with the end portions of the locking arms, whereby axial pressure can be applied to the end portions of the locking arms to disengage the radially outward facing surfaces of the locking arms from the radially inward facing surfaces of the walls of the rings.

The resiliently bendable locking arms can be unitary parts of the cores segments. Alternatively, each of the locking arms can comprise a resilient metal sheet fastened to one of the core segments, and a resin block secured to the metal sheet and engageable by a snap fit with one of the rings.

In a preferred embodiment, the arc-shaped connecting elements formed on the core segments are radially inward facing slots, and the arc-shaped connecting elements formed on the rings are annular elements protruding radially outward. Each said annular element extends into one of the radially inward facing slots.

In the preferred embodiment, each of the radially extending slots of each ring is defined by the wall thereof and a pair of opposed sides protruding from the wall in spaced relationship to each other toward the opposite ring. The opposed sides are progressively closer to each other proceeding radially inward toward the core axis so that each slot is tapered. Each core segment includes a pair of rigid elements adjacent each of its locking arms. These rigid elements protrude substantially radially inward, and are circumferentially spaced from each other on opposite sides of the adjacent locking arm. The rigid elements have circumferentially facing outer sides that are also progressively closer to each other proceeding radially inward. These outer sides conform to and engage the opposed sides of a radially extending slot when the outwardly facing surface of the adjacent locking arm is engaged with the inwardly facing surface of the wall of the last-mentioned slot.

In the embodiment having rigid elements adjacent the locking arms, a rib extending axially along each core element is preferably provided to connects the rigid elements adjacent the locking arm at one end of each core segment to the rigid elements adjacent the locking arm at the other end thereof, thereby ensuring that the rigid elements are firmly supported in fixed relationship to the core segment.

The rigid elements adjacent each locking arm also preferably extend substantially radially inward beyond the innermost end of the adjacent locking arm to protect the locking arm from damage, especially when the core segments are stacked for shipment or storage.

The reel according to the invention is highly robust. Its overall strength, and the strength of the connections of the core components to the rings, are sufficiently high that the reel can withstand impact, temperature changes, and other stresses with a very low incidence of failure. At least the core and ring portions, and often the entire reel including the flanges, can be disassembled and re-used repeatedly without failure. Moreover, the reel can be assembled and disassembled quickly and easily by an individual worker without the use of tools.

Further objects and advantages of the invention will be apparent from the following description when read in conjunction with the drawings.

DETAILED DESCRIPTION OF THE PREFERRED EMBODIMENTS

Figure 1:
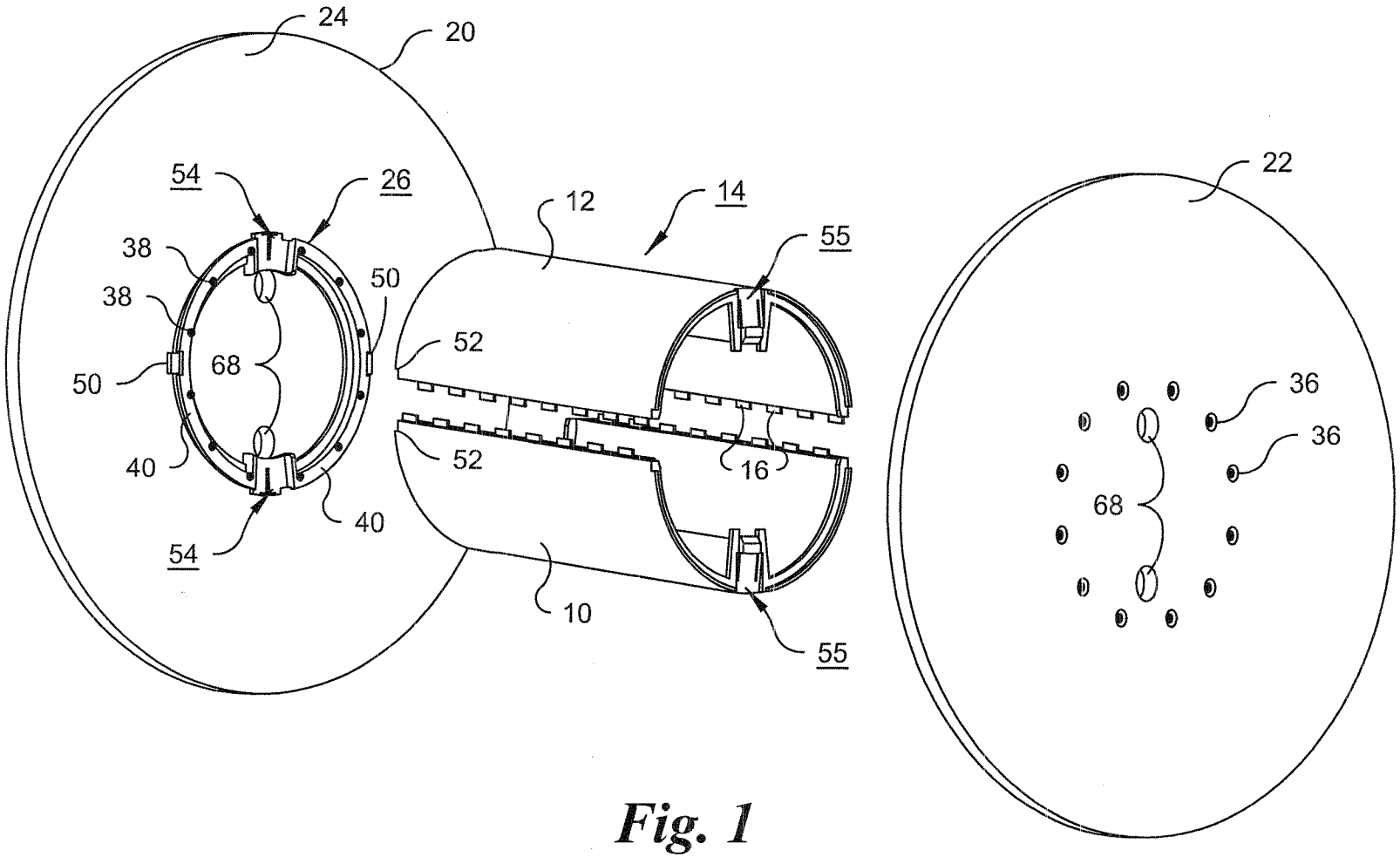
FIG. 1 is an exploded perspective view of a reel in accordance with the invention.

As shown in FIG. 1, a preferred embodiment of the reel according to the invention comprises two complementary arc-shaped segments 10 and 12, which can be connected together to form a core 14 having a substantially circular, cylindrical outer surface symmetrical about a core axis. Each segment has two opposite edges, each having a row of tabs 16 and a row of slots 18 (FIG. 6), the tabs and slots being arranged in alternating relationship. When the segments are joined, the tabs of each segment fit into the slots of the other segment.

Although the core is preferably composed of two complementary arc-shaped segments, it is possible to form the core from three or more complementary arc-shaped segments whose arcs subtend angles totalling 360 degrees.

Flanges 20 and 22 are disposed respectively at axially spaced opposite ends of the core. The flanges, which are typically composed of wood, although other suitable materials can be used, can be identical, and have inner sides facing each other. The inner side 24 of flange 20 is visible in FIG. 1.

Figure 2:
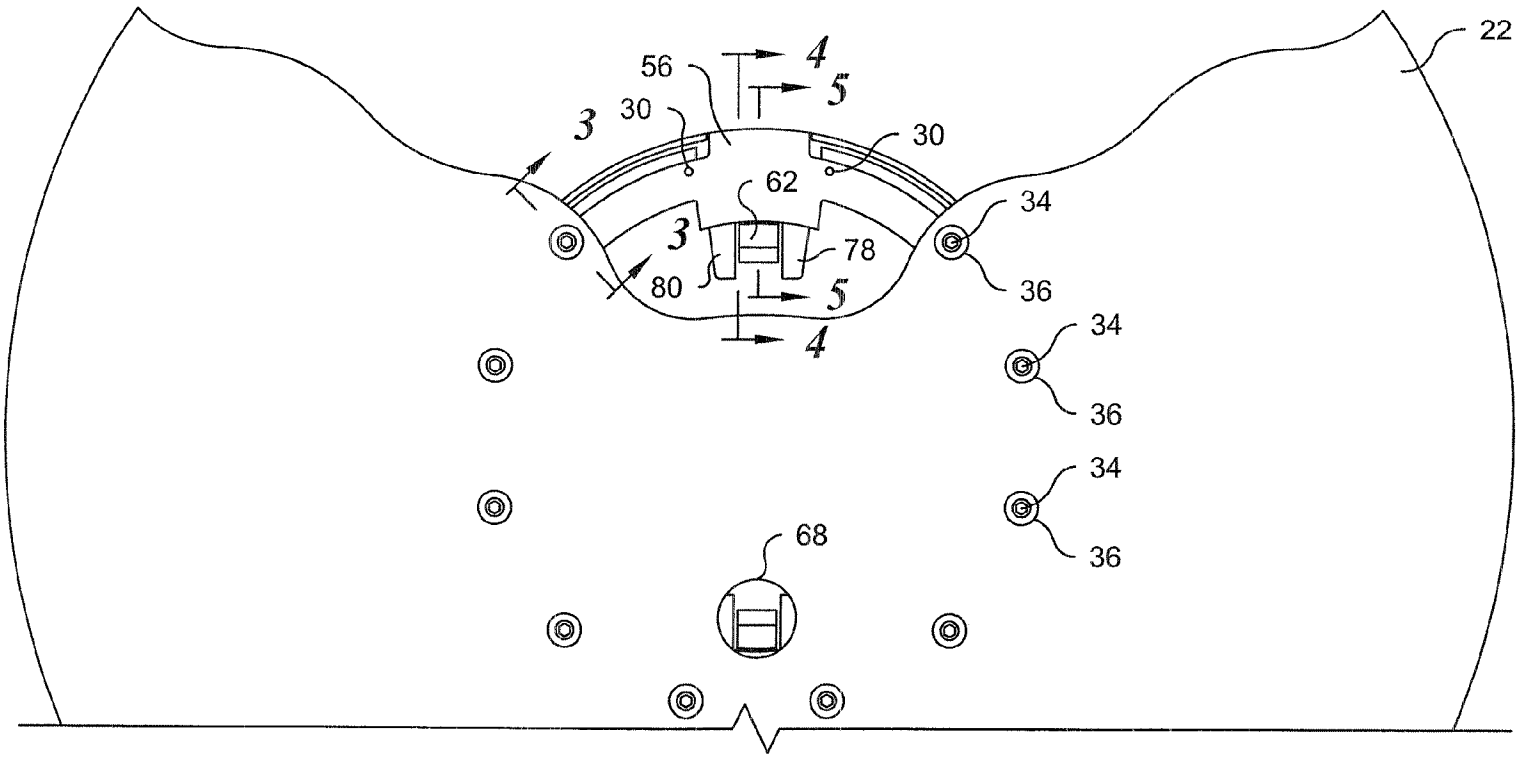
FIG. 2 is a broken-away end view of the reel.
Figure 3:
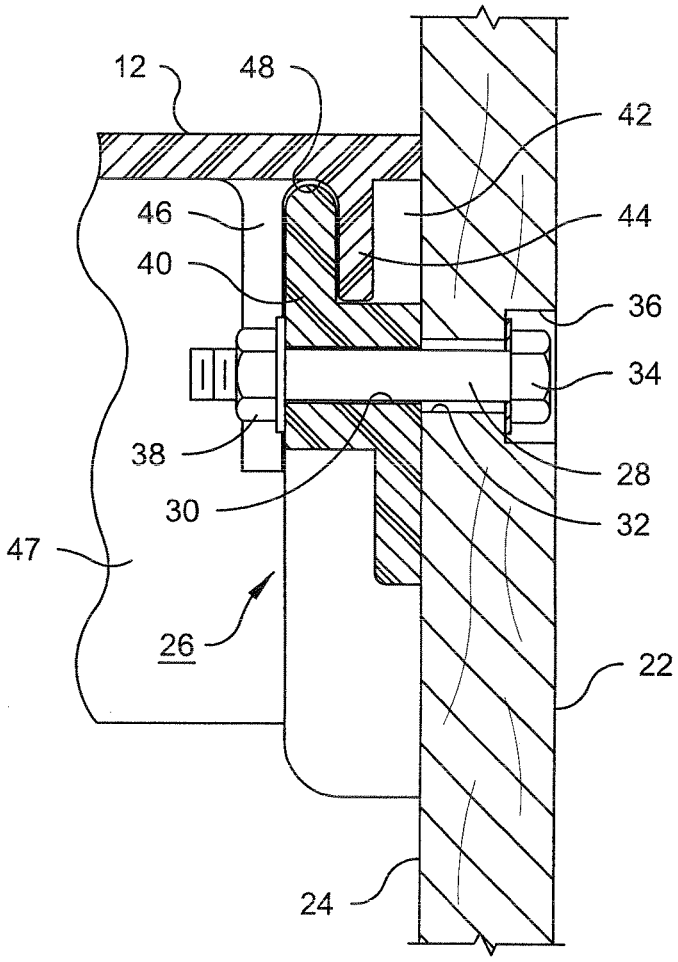
FIG. 3 is a sectional view taken on plane 3-3 in FIG. 2.

Rings are fixed respectively to the inner sides of flanges 20 and 22, one such ring is ring 26 in FIG. 1. The rings are preferably identical and can be fastened to the flanges by means of bolts 28 (FIGS. 2 and 3). The bolts extend through holes 30 in the rings, and through corresponding holes 32 (FIG. 3) in the flanges 20 and 22, holes 32 being aligned with holes 30. As shown in FIG. 3, the heads 34 of the bolts are disposed in recesses 36 in the flanges. The bolts are secured to the rings by nuts 38. For added strength, the recesses in the flanges can be lined with metal cup washers (not shown).

Each ring has a series of radially outward protruding annular parts, one such part 40 being seen in FIG. 3. Part 40 is spaced from the inner side 24 of the adjacent flange 22 to provide a space 42 for receiving an inwardly protruding part 44 of an arc-shaped segment 12.

A wall 46 extends inwardly from the outer part of the arc-shaped segment 12 as a unitary part thereof, and is reinforced by longitudinally extending ribs, which are also formed as unitary parts of the arc-shaped segment, one such rib being rib 47 in FIG. 3. The wall 46, which is in spaced relationship with inwardly protruding part 44, cooperates with part 44 to form and annular slot 48 which receives outwardly protruding annular part 40 of the ring 26. Slot 48, and corresponding similar slots (not shown) are disposed around the circumference of the core 14 at both ends thereof and fit the outwardly protruding annular parts 40 of the rings closely in order to secure the arc-shaped segments of the core firmly to the rings. Movement of annular parts 40 into the slots is limited by engagement between the outer perimeters of the annular parts with the bottoms of slots 48.

As seen in FIG. 1, the protruding annular parts 40 of the ring are interrupted by two outwardly extending protrusions 50 located opposite each other on opposite sides of the ring. These protrusions extend into slots formed by notches 52 when the two parts of the core are brought together. The annular parts 40 of each ring are also interrupted by slots 54, which receive locking parts 55 formed at both ends of each of the arc-shaped core segments 10 and 12.

In the process of assembly of the reel, the wooden flanges, with rings 26 attached to them, are positioned so that their protruding annular parts 40 enter the slots 48 of the core parts 10 and 12 are brought together. The locking parts 55 on the core segments enter the slots 54 of the rings and secure the core parts to the rings in the manner depicted in FIGS. 4 and 5.

Figure 4:
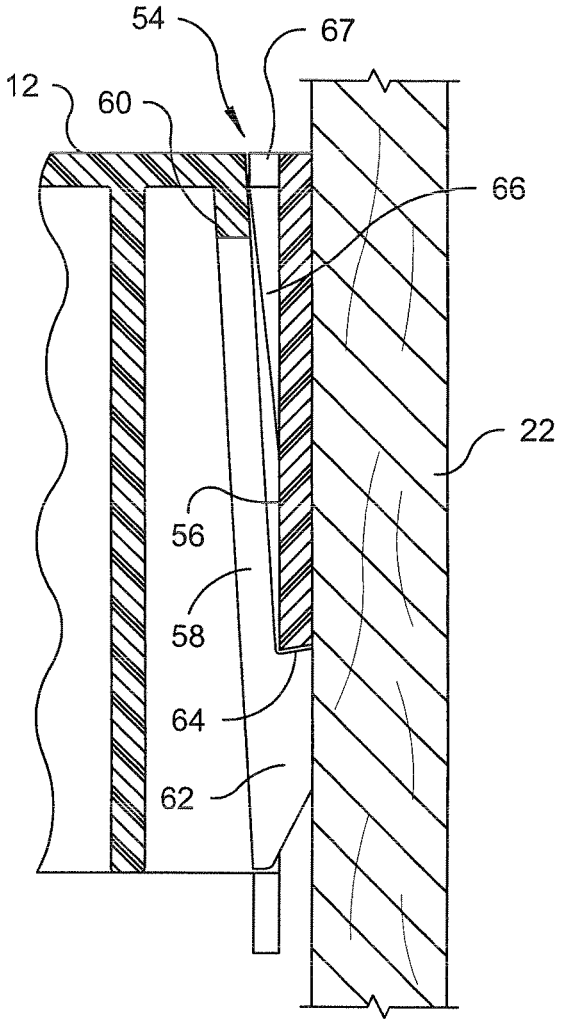
FIG. 4 is a sectional view taken on plane 4-4 in FIG. 2.
Figure 5:
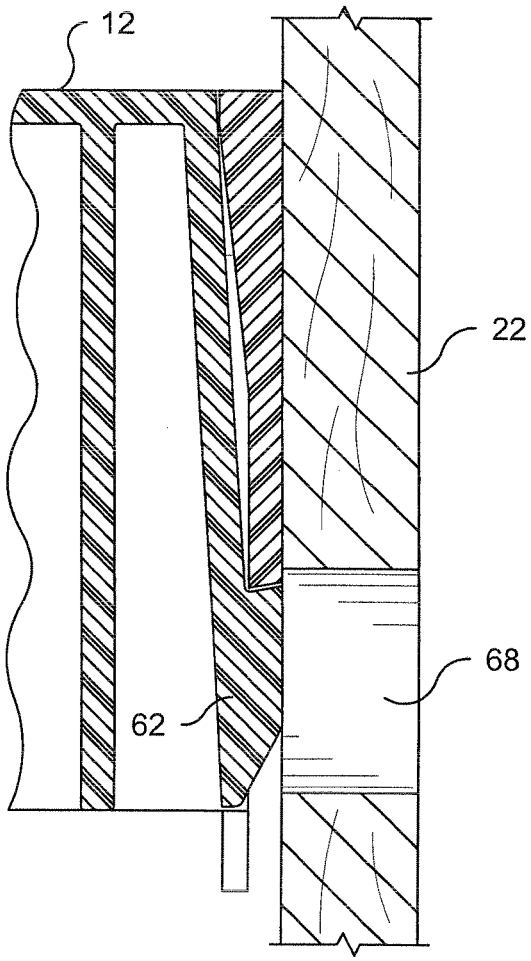
FIG. 5 is a sectional view taken on plane 5-5 in FIG. 2.

As shown in FIG. 4, a slot 54 of a ring includes a wall 56, which is in abutting relationship with a wooden flange when the ring is attached to the flange. The locking member includes a hook-shaped arm 58 connected at one end 60 to an end of an outer wall of a core part 12, and having an enlargement 62 at its opposite end that extends underneath wall 56 to lock the core part to the ring. The position of the part 64 of the enlargement 62 that extends underneath the inner end 64 of wall 56 is preferably such that, when the annular ring element 40 is in full engagement with the bottom of a slot 48 as shown in FIG. 3, only a very small clearance, e.g., around 1 mm, exists between part 62 and the inner end 64 of wall 56. Preferably, the inner end 64 of wall 56 and the surface of the enlarged part 62 of the arm that engages the end of the wall are both disposed at an angle of about 10 E as shown in FIGS. 4 and 5 so that the edge of the inner end of the wall closest to the flange 22 is slightly radially outward from the edge remote from the flange. These angled parts of the wall and the arm aid in preventing accidental unlatching.

The arm 58 is resilient, so that its enlarged part 62 snaps into place underneath the inner end 64 of the wall, thereby securely holding the core part and the ring in engagement with each other. A spacer 67 is formed on wall 56 adjacent the outer end thereof to maintain a spacing between the wall and the locking arm 58. The enlarged part 62 of the locking arm is deflected by a ramp 66 on the front part of wall 56 as the core parts are brought out of engagement with the rings, so that the enlarged part 62 can clear spacer 67.

As shown in FIG. 5, a hole 68 is provided in the flange, adjacent the inner end 64 of wall 56 and in register with the enlarged part 62 of the resilient arm 58, to allow access to the arm so that the arm can be disengaged from the wall by pushing it manually, or by means of a tool. Thus, the core parts can be readily and easily disconnected from the rings and from each other for disassembly of the reel.

Figure 6:
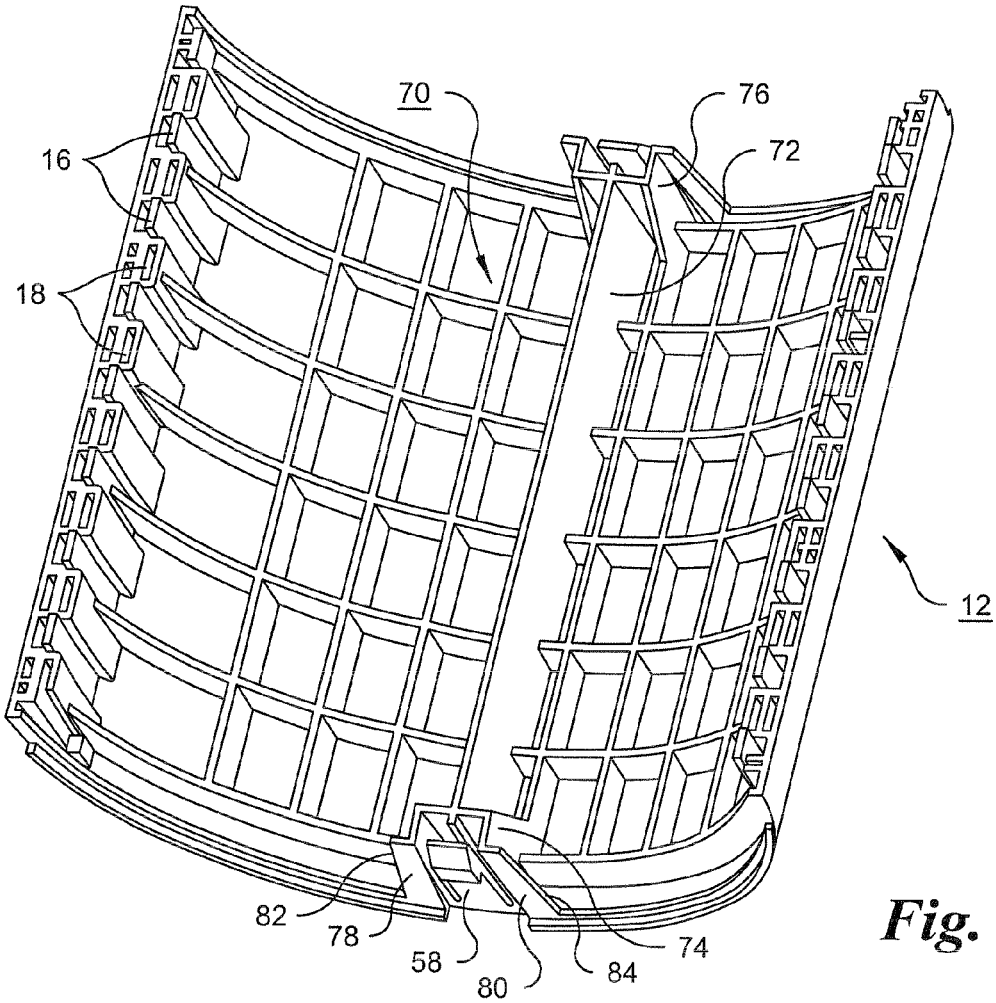
FIG. 6 is a perspective view showing details of the inside of one of the two core halves 10 and 12.

As shown in FIG. 6, the arc-shaped segment 12 has rows of tabs 16, the tabs being in alternating relationship with slots 18. The two core segments are preferably identical, and therefore capable of being produced in the same mold.

Figure 7:
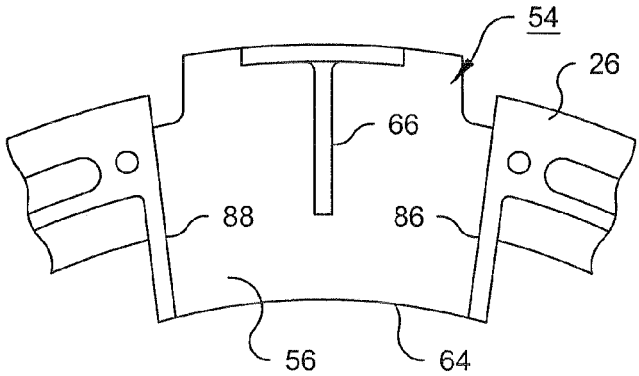
FIG. 7 is a fragmentary elevational view of a part of an attachment ring.

Each core segment is reinforced by an array 70 of ribs formed as parts of the inner surface of the core. Included in the reinforcing ribs is a central rib 72 which rigidly connect U-shaped parts 74 and 76 of the locking members at opposite ends of the core parts. The legs of part 74 are formed with rigid protrusions 78 and 80, which are located in circumferentially spaced relationship to each other on opposite sides of locking arm 58. These rigid protrusions extend beyond the inner end of locking arm 58, and protect the locking arm from damage when the core segments are stacked one upon another for shipment after disassembly of the reel. The rigid protrusions 78 and 80 have outer edges 82 and 84, which gradually become closer together proceeding radially inward toward the core axis. As shown in FIG. 7, a slot 54 in ring 26 has opposed sides 86 and 88, which protrude from the wall 56 in spaced relationship to each other toward the opposite ring. These opposed sides are progressively closer to each other proceeding radially inward toward the axis, causing the slot to be tapered. The tapered relationship of sides 86 and 88 correspond to the tapered relationship between the outer edges of protrusions 78 and 80, and the outer edges of the protrusions conform to and engage the opposed sides 86 and 88 of slot 54 when the outwardly facing surface of the locking arm 58 adjacent and between protrusions 78 and 80 is engaged with the inwardly facing end surface 64 of wall 56. The matching tapered relationship of the protrusions and the sides of slot 54 helps to ensure that the core segments remain firmly attached to the rings when the locking elements are engaged.

The core segments and rings can be molded from any of a variety of materials. Suitable materials include polycarbonate resin, e.g., Sabic FL910 polycarbonate, and various glass fiber-reinforced polycarbonate resins.

Figure 8:
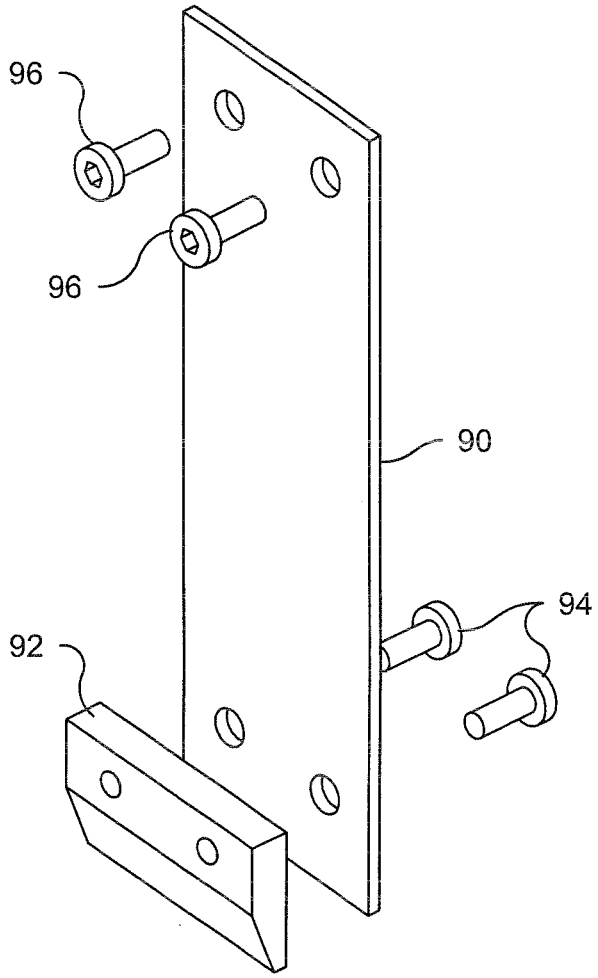
FIG. 8 is an exploded view showing an alternative locking arm composed of a resilient strip of sheet metal and a resin block.
Figure 9:
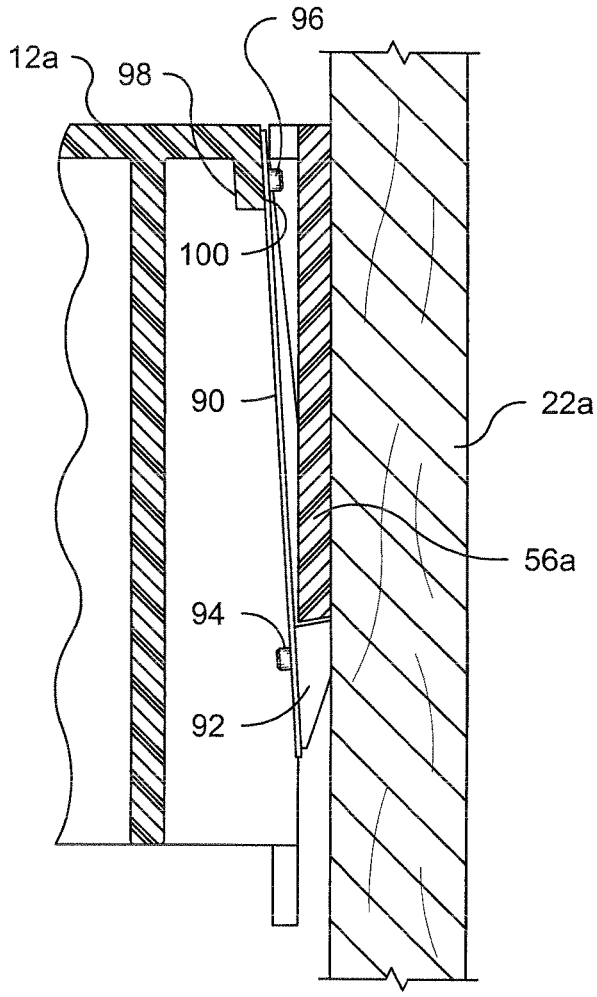
FIG. 9 is a sectional view corresponding to FIG. 4 but showing the alternative locking arm engaged with a wall 56.

In the alternative embodiment illustrated in FIGS. 8 and 9, the locking arm is composed of a rectangular strip 90 of sheet metal and a resin block 92 secured together by fasteners 94. The sheet metal strip is sufficiently thin that it can be bent manually, and resilient so that it returns to its original condition when released after being bent. Any of a various kinds of sheet steel, suitably heat-treated, can be used for the sheet metal strip 90, as can other metals having suitable spring characteristics. The resin block 92 can be molded from any suitable polymeric resin, including the resins mentioned above, and preferably has a shape similar to that of enlarged part 62 of arm 58 as shown in FIGS. 4 and 5.

As shown in FIG. 9, metal strip 90 is secured by fasteners 96 to an inwardly protruding flange 98 formed on arc-shaped core segment 12*a*. If the metal strip is normally flat in its relaxed condition, the outer wall 100 of flange 98 should have a slight slope so that block 92 is positioned underneath wall 56*a* when the metal strip is relaxed.

The locking arm operates in the same manner as the integral locking arm in the previously described embodiment. The arm snaps into place when the core segment to which it is attached is slid into engagement with the ring fastened to a wood reel flange, and can be disengaged manually by being by a tool inserted through an access hole (not shown) in the reel flange.

An advantage of the alternative locking arm is that it avoids difficulties encountered in molding the locking arm as a unitary part of a core segment. Another advantage is that it can be stronger than the unitary resin arm, and yet easier to bend both in assembly and disassembly of the reel.

Still another alternative, not illustrated, is the use of a locking arm that is entirely composed of sheet metal, wherein the block for engaging the inner end of a locking wall on the ring consists of an extension of the metal strip suitably bent into the form of a latching block corresponding to block 92 in FIGS. 8 and 9.

Still other variations of the invention will become apparent to those skilled in the art, and can be adopted without departing from the scope of the invention as defined in the following claims.

What is claimed is:

1. A reel comprising:

a cylindrical core composed of two complementary arcuate core segments;

a pair of flanges disposed respectively at axially spaced opposite ends of the core;

a pair of rings for connecting the core to the flanges, the rings being fixed respectively to facing inner sides of the flanges;

cooperating slots and tongues on the rings and core segments for preventing the flanges from moving relative to the core in the direction of the axis of the cylindrical core, said tongues entering the slots when the core segments are brought together; and resiliently displaceable locking arms having portions protruding radially inward from both ends of each core segment, each locking arm portion having an end portion with a radially outward facing locking surface, said arms being resiliently displaceable to move through a limited range in a direction substantially parallel to said axis;

each ring having a wall positioned for sliding engagement with said locking arm and for displacing the locking arm axially as the locking arm moves radially inward;

said wall also having a radially inward facing surface for locking engagement with said radially outward facing locking surface of said locking arm, the inwardly facing surface of the wall and the outwardly facing locking surface of the locking arm being positioned for automatic snap fit engagement with each other by said resilient displacement of the arm when the core segments are fully engaged; and wherein each of said flanges has a through access aperture in register with the end portion of each locking arm, whereby axial inward pressure can be applied to said end portion of said locking arm to disengage the radially outward facing surface of the locking arm from the radially inward facing surface of the wall of said ring for enabling the reel to be dismantled.

2. A reel according to claim 1 in which each of the resiliently displaceable locking arms is a unitary part of one of the core segments.

3. A reel according to claim 1, in which each of the resiliently displaceable locking arms comprises a resilient displaceable bendable metal sheet fastened to one of the core segments.

4. A reel according to claim 1, in which each of the resiliently displaceable locking arms comprises a resilient bendable metal sheet fastened to one of the core segments, and a resin block secured to the metal sheet and engageable by a snap fit with one of said rings.

5. A reel comprising:

a core having a substantially circular cylindrical outer surface symmetrical about a core axis, the core being composed of a plurality of complementary, connected, arcuate core segments, the core having two axially spaced opposite ends;

a pair of flanges disposed respectively at the axially spaced opposite ends of the core, the flanges having inner sides facing each other;

a pair of rings for connecting the core to the flanges, the rings being fixed respectively to the inner sides of the flanges whereby the rings are located opposite to each other;

arc-shaped connecting elements formed on the core segments at the opposite ends of the core;

arc-shaped connecting elements formed on the rings;

the arc-shaped connecting elements of the core segments being engageable with the arc-shaped connecting elements formed on the rings and being fully engaged when the arcuate core segments are in complementary relationship to form a said core having a circular cylindrical outer surface, whereby the flanges are locked against axial movement relative to the core;

the arc-shaped connecting elements of the core segments being movable radially outward relative to said axis for disengagement from the arc-shaped connecting elements formed on the rings;

locking arms connected to, and extending radially inward from, both ends of each core segment, the locking arms having end portions with radially outward facing locking surfaces, said locking arms being resiliently bendable whereby the end portions of said arms can move through a limited range in a direction substantially parallel to said axis;

each ring having radially extending slots for receiving said locking arms, whereby the locking arms can move radially inward in said slots when the arc-shaped connecting elements of the core segments are engaged with the arc-shaped connecting elements formed on the rings;

each said slot of each ring having a wall facing the opposite ring, the wall being positioned for sliding engagement with one of said locking arms and for bending said one of said locking arms toward said opposite ring as said one of said locking arms moves radially inward;

said wall also having a radially inward facing surface mutually engageable with the radially outward facing surface of said one of said locking arms, said mutually engageable radially inward facing surfaces and the radially outward facing surfaces being positioned for automatic engagement with each other by resilient movement of the arms when the arc-shaped connecting elements of the core segments are fully engaged with the arc-shaped connecting elements formed on the rings; and the end portion of the locking arm connected to each end of each core segment being manually movable, in said direction substantially parallel to said axis, toward the opposite end of the same core segment through a distance sufficient that, when the radially outward facing surface of said end portion is in mutual engagement with the radially inward facing surface of a wall of one of said rings, the last-mentioned radially outward facing surface and radially inward facing surface can be disengaged.

6. A reel according to claim 5, in which said flanges have access apertures in register with the end portions of the locking arms, whereby axial pressure can be applied to said end portions to disengage the radially outward facing surfaces of the locking arms from the radially inward facing surfaces of the walls of said rings.

7. A reel according to claim 5 in which each of the locking arms is a unitary part of one of the core segments.

8. A reel according to claim 5, in which each of the locking arms comprises a resilient metal sheet fastened to one of the core segments.

9. A reel according to claim 5, in which each of the locking arms comprises a resilient metal sheet fastened to one of the core segments, and a resin block secured to the metal sheet and engageable by a snap fit with one of said rings when the core segments are brought together.

10. A reel according to claim 5, in which the arc-shaped connecting elements formed on the core segments are radially inward facing slots, in which the arc-shaped connecting elements formed on the rings are annular elements protruding radially outward, each said annular element extending into one of said radially inward facing slots.

11. A reel according to claim 5, in which each of said radially extending slots of each ring is defined by the wall thereof and a pair of opposed sides protruding from the wall in spaced relationship to each other toward the opposite ring, the opposed sides being progressively closer to each other proceeding radially inward toward said axis whereby each slot is tapered, and in which each core segment includes a pair of rigid elements adjacent each of the locking arms of the last-mentioned core segment, each of said rigid elements protruding substantially radially inward into one of said slots, and being circumferentially spaced from each other on opposite sides of the adjacent locking arm, said rigid elements having circumferentially facing outer sides that are also progressively closer to each other proceeding radially inward, said outer sides conforming to and engaging the opposed sides of the radially extending slot into which the last-mentioned rigid element protrudes when the outwardly facing surface of the adjacent locking arm is engaged with the inwardly facing surface of the wall of the last-mentioned slot.

12. A reel according to claim 11, including a rib extending axially along each core element, said rib rigidly connecting the rigid elements adjacent the locking arm at one end of each core segment to the rigid elements adjacent the locking arm at the other end thereof.

13. A reel according to claim 11, in which said rigid elements adjacent each locking arm extend substantially radially inward beyond the innermost end of the adjacent locking arm.

* * * * *